United States Patent [19]

Arora

[11] Patent Number: 4,611,192

[45] Date of Patent: Sep. 9, 1986

[54] HEAVY-DUTY TIME-DELAY FUSE

[75] Inventor: Guru B. Arora, N. Arlington, N.J.

[73] Assignee: Eagle Electric Mfg. Co., Inc., Long Island, N.Y.

[21] Appl. No.: 694,802

[22] Filed: Jan. 25, 1985

[51] Int. Cl.[4] ..... H01H 71/20; H01H 85/04

[52] U.S. Cl. ..... 337/165; 337/163

[58] Field of Search ..... 337/163, 164, 165, 166

[56] References Cited

U.S. PATENT DOCUMENTS

| | | | |
|---|---|---|---|
| 2,577,531 | 12/1951 | Laing | 337/164 |
| 3,046,374 | 7/1962 | Wright | 337/165 |
| 3,291,943 | 12/1966 | Kozacka | 337/163 |

*Primary Examiner*—Harold Broome

*Attorney, Agent, or Firm*—Kirschstein, Kirschstein, Ottinger & Israel

[57] ABSTRACT

A heavy-duty, time-delay fuse includes a pair of heat sinks having mutually facing, generally planar contact surfaces normally eutectically soldered to each other. A spring between the heat sinks is operative for urging the contact surfaces apart from each other in a direction generally perpendicular to the planes in which the contact surfaces lie in the event of an overload condition in which an overload electrical current causes a pair of fusible links to generate sufficient heat to melt the eutectically soldered interconnection between the contact surfaces after a predetermined time delay proportional to the amount of heat absorbed and dissipated by the heat sinks.

14 Claims, 5 Drawing Figures

HEAVY-DUTY TIME-DELAY FUSE

BACKGROUND OF THE INVENTION

1. Field of the Invention

This invention generally relates to a heavy-duty, time-delay current-limiting fuse and, more particularly, to a fuse capable of reliably handling electrical currents in such amperage ranges as 61 to 100 amps., 101 to 200 amps., 201 to 400 amps. and 401 to 600 amps.

2. Description of the Prior Art

Heavy-duty current-limiting fuses are well known in the art for conducting electrical currents in predetermined safety amperage ranges along an electrical circuit, and for interrupting the electrical circuit in an overload condition when the electrical current exceeds the safety range. Typically, such a heavy-duty fuse consisted of a cartridge in which one elongated element was slidably received at least partially within and on another elongated element. The two elements were eutectically soldered together along at least a portion of their lengths, and were respectively connected to a pair of fusible links which, in an overload condition, generated sufficient heat to melt the solder after a time delay. When the solder melted, a spring was released to urge the two elements lengthwise apart from each other.

Although generally satisfactory for their intended purpose, the prior art fuses were not altogether reliable in operation because the elements in certain instances had a tendency to restrike, i.e. to again electrically contact each other and conduct the electrical current therethrough along the electrical circuit. In addition, after the solder melted, the spring moved the two elements only slightly apart lengthwise. Where high amperage currents were involved, this slight spacing between the elements sometimes was insufficient to prevent arcing between the elements. The prior art fuses also required a time-consuming and painstaking assembly procedure.

SUMMARY OF THE INVENTION

1. Objects of the Invention

It is a general object of the present invention to overcome the aforementioned drawbacks of prior art heavy-duty current-limiting fuses.

It is another object of the present invention to minimize, if not eliminate, the problem of arcing in such fuses.

It is a further object of the present invention to minimize, if not eliminate, the problem of restriking in such fuses.

It yet another object of the present invention to provide such a reliable fuse which is easy and inexpensive to assemble.

It is still another object of the present invention to provide such a durable fuse which is safe in use.

2. Features of the Invention

In keeping with these objects, and others which will become apparent hereinafter, one feature of the invention resides, briefly stated, in a heavy-duty current-limiting fuse which comprises an elongated, hollow, tubular housing having opposite end regions and bounding an interior space. A pair of electrically-conducting terminals respectively are located at, and extend outwardly past, a respective end region of the housing. A pair of elongated fusible links are located within the interior space, and each extends between a first end region which is electrically connected to a respective terminal, and a second end region which has opposite abutment surfaces. The second end regions are longitudinally spaced apart from each other. Each link is constituted of an electrically-conducting material for enabling an electrical current conducted between the terminals to flow along the links. Each link is adapted to at least partially resist the electrical current flow therethrough for generating heat in an amount proportional to the magnitude of the electrical current flow.

In further accordance with this invention, a pair of heat sinks are located within the interior space, and have generally planar juxtaposed contact surfaces facing each other in a mutual parallelism. Each contact surface is located at, and normally is interconnected by a eutectically soldered bond to, respective abutment surfaces of both links. Each heat sink extends longitudinally between and bridges the spaced-apart second end regions. Each heat sink is constituted of an electrically-conducting material, e.g. copper, for enabling the electrical current to flow along the heat sinks, and for at least partially absorbing and dissipating the heat amounts generated by the links. Each eutectically soldered bond is meltable at a predetermined melting point. In a preferred embodiment, the solder is composed of tin and lead combined, respectively, in a ratio of 63% to 37% by weight, and has a melting point of about 360° F.

Biasing means, preferably a compressible coiled spring, is located within the interior space between the heat sinks. The biasing means is operative for urging the contact surfaces apart from each other in a direction generally perpendicular to the planes in which the contact surfaces lie in the event of an overload condition in which an overload electrical current having a magnitude above that of a rated electrical current is conducted between the terminals, and causes the links to generate heat, and the second end regions to conduct the heat, in an overload amount exceeding said predetermined melting point and sufficient to melt the eutectically soldered bonds between the contact surfaces and the respective abutment surfaces after a predetermined time delay proportional to the amount of heat absorbed and dissipated by the heat sinks.

The movement of the contact surfaces apart from each other in the aforementioned perpendicular direction minimizes the possible re-striking and arcing problems of the prior art fuses.

The assembly of the above-described fuse is easy and inexpensive to perform. The resulting fuse is durable in construction and is safe in use.

Another feature of the invention resides in providing a plurality of partitions for mounting within and subdividing the interior space of the housing into a first shortcircuit chamber at one end region of the housing, a second shortcircuit chamber at the other end region of the housing, and an overload chamber intermediate the first and second shortcircuit chambers. The aforementioned heat sinks, biasing means and second end regions of the fusible links all are contained within the overload chamber.

Still another advantageous feature of this invention resides in providing each link with a bent body portion which is apertured to reduce the effective cross-section of the link and to increase the resistance offered to the electrical current flowing through the respective link. In the event of a shortcircuit, each apertured bent body portion fuses almost instantaneously. However, in the event of an overload condition, i.e. wherein the magnitude of the overload current is at most about 500% above that of the rated electrical current, the bent body portion does not fuse but, instead, conducts the current to the second end region with the concomitant generation of heat thereat. A filler of a particulate material surrounds the bent body portion of each link in each shortcircuit chamber.

Each heat sink is advantageously provided with a centrally-located bore having an interior annular shoulder, and a through-hole aligned with the bore. The aforementioned compressible spring has opposite end sections, each seated in a respective bore and engaging the respective shoulder. In a normal working condition, the spring is normally compressed between the heat sinks, and energy is stored in the spring. In an overload condition, the energy in the spring is released and the spring extends toward its uncompressed length and is operative to urge the contact surfaces apart from each other.

A pair of spacer elements also are provided within the overload chamber at opposite sides of the heat sinks. Each element has a guide projection extending in the direction of movement of the contact surfaces. Each guide projection is received at least partially within a respective through-hole of the heat sinks after the contact surfaces have been moved apart from each other. In addition, the opposite end sections of the spring have axial open ends and, hence, in a preferred embodiment, the guide projections also respectively are received in the open ends of the spring. This construction, in effect, serves to maintain the heat sinks in the overload condition away from each other, and tends to minimize the possibility that the heat sinks again will electrically engage each other and restrike.

Each heat sink preferably is constituted of a plate-shaped copper material, and has a mass sufficient to absorb and dissipate heat in amounts sufficient to melt the eutectically soldered bonds after a time delay of about ten seconds minimum in the event of an overload current having a magnitude which is 500% above the rated current, about twelve minutes maximum in the event that the overload current is 200% above the rated current, and about two hours maximum in the event that the overload current is 135% above the rated current. The mass also is sufficient never to melt the eutectically soldered bonds when the overload current is 110% above the rated current.

The novel features which are considered as characteristic of the invention are set forth in particular in the appended claims. The invention itself, however, both as to its construction and its method of operation, together with additional objects and advantages thereof, will best be understood from the following description of specific embodiments when read in connection with the accompanying drawings.

DETAILED DESCRIPTION OF THE PREFERRED EMBODIMENTS

Figure 1:
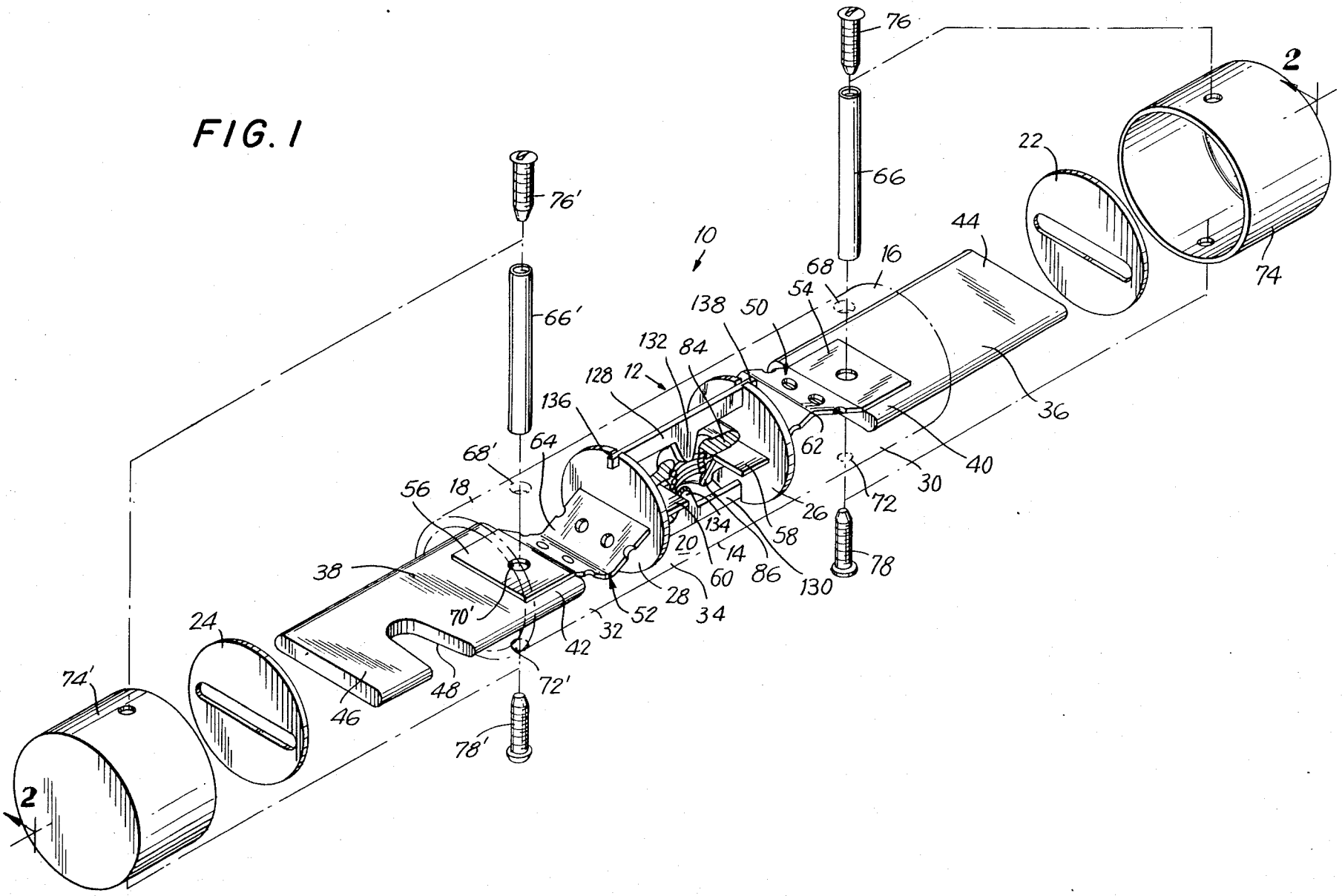
FIG. 1 is an exploded view of a heavy-duty current-limiting fuse during assembly in accordance with this invention.

Referring now to the drawings and, more particularly, to FIG. 1, reference numeral 10 generally identifies a heavyduty current-limiting fuse for installation into a fuse holder in an electrical circuit which, in normal operation, conducts electrical current of high amperage to a load. The fuse 10 comprises an elongated, hollow, tubular housing 12, preferably made of an electrically-insulating fiber, and is symmetrical lengthwise along a longitudinal axis. The housing 12 has a cylindrical side wall 14 circumferentially bounding an interior space 20, and has a pair of opposite end regions 16, 18. First and second circular end partitions 22, 24 respectively overlie and close opposite open axial ends of the end regions 16, 18 of the housing. Both end partitions 22, 24 preferably are made of an electrically-insulating fiber.

Mounted within the housing 12 are a pair of longitudinally spaced-apart barrier partitions 26, 28, also preferably composed of an electrically-insulating fiber. Barrier partitions 26, 28 are spaced longitudinally from end partitions 22, 24, respectively, and bound therewith a first and a second shortcircuit chamber 30, 32 within the housing 12. An overload chamber 34 is bounded by the barrier partitions 26, 28 between the shortcircuit chambers 30, 32.

A pair of electrically-conducting plate-shaped blades or terminals 36, 38, preferably constituted of copper, are located at the opposite end regions 16, 18. Terminals 36, 38 have interior end regions 40, 42 respectively located within shortcircuit chambers 30, 32. Terminals 36, 38 extend longitudinally outwardly in opposite directions from their interior end regions 40, 42 past the housing end regions 16, 18, and terminate in exterior free end regions 44, 46. Terminals 36, 38 are connected to corresponding sockets in a conventional fuse holder. A pin-receiving cut-out 48 is formed in terminal 38 for receiving a pin of the fuse holder.

A pair of elongated, generally planar, thin, electrically-conducting, fusible links 50, 52, preferably made of copper, are located within the housing. Links 50, 52 have generally planar first end regions 54, 56 respectively soldered to the interior end regions 40, 42 of the terminals within the shortcircuit chambers 30, 32. A high-temperature-melting noneutectic solder is employed, preferably one constituting a lead-tin alloy in the ratio of 70% of lead to 30% of tin by weight, and having a melting point of approximately 450° F.

Figure 2:
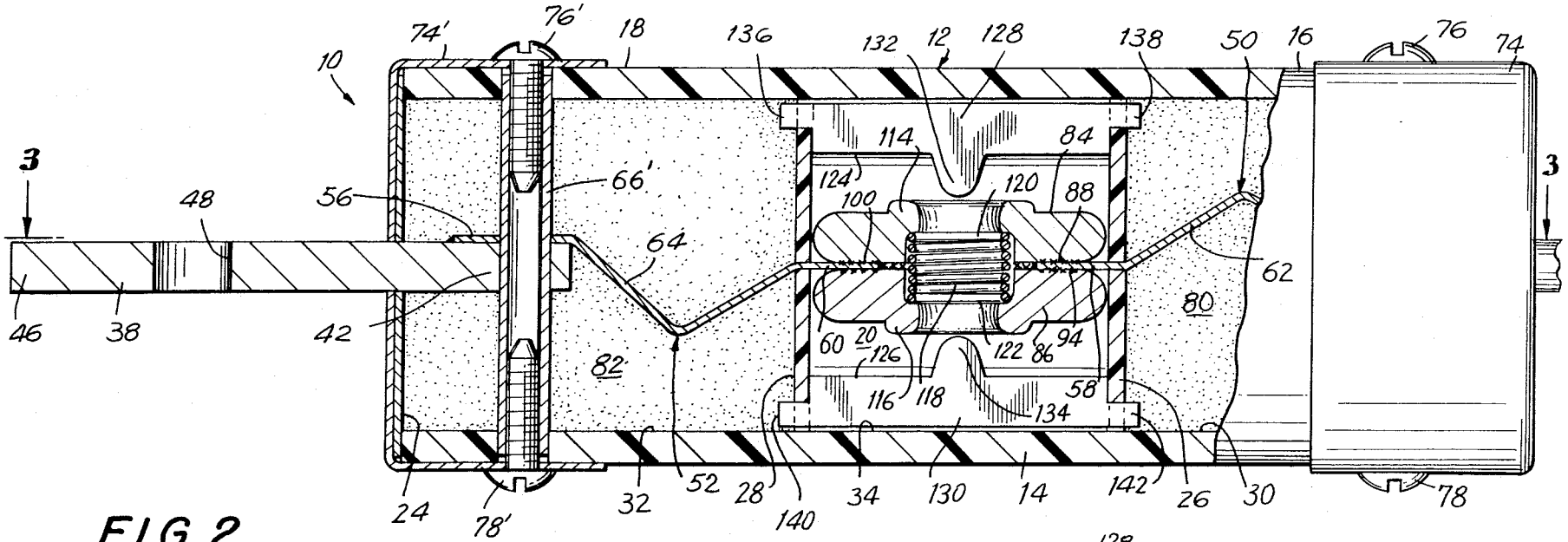
FIG. 2 is a longitudinal sectional view taken along line 2—2 of FIG. 1 after complete assembly of the fuse.

Links 50, 52 also have generally planar second end regions 58, 60, respectively, which are located within the overload chamber 34. As best shown in FIG. 2, the second end regions 58, 60 are longitudinally spaced-apart from each other.

Intermediate the first and second end regions of the links 50, 52 are generally planar bent body portions 62, 64 which are apertured in conventional manner to decrease the effective cross-section of the links and at least partially increase the resistance of the links to the flow of electrical current therethrough. As described below, the resistance to electrical current flow generates heat in an amount directly proportional to the magnitude of the electrical current. This heat is employed in detecting an overload condition. The number of apertures and their spacing along the length and width of the bent body portions 62, 64 are entirely conventional and form no part of this invention. The bend in each link is intended to shorten the length of each shortcircuit chamber and thereby shorten the overall length of the housing 12.

The first end regions 54, 56 and the terminals 36, 38 soldered thereto securely and fixedly are anchored to the housing end regions 16, 18 by respective anchoring assemblies. The anchoring assembly for the link end region 54 and the terminal end region 40 comprises a hollow, tubular, steel pin 66 successively inserted through an upper hole 68 formed in an upper side of the side wall 14, an intermediate hole 70 formed through the overlapped link end region 54 and terminal end region 40, and a lower hole 72 formed in the lower side of the side wall 14. A generally cup-shaped end cap 74 is fitted tightly over the housing end region 16, and has a pair of upper and lower holes which respectively register with the upper and lower holes 68, 72. A pair of steel drive pins or screws 76, 78, respectively, are forced into and wedged in the opposite ends of the hollow pin 66. The heads of the drive pins 76, 78 retain the anchoring assembly in place by clamping the annular skirt of the end cap 74 to the exterior surfaces of the housing end region.

The anchoring assembly for the link end region 56 of the terminal end region 42 is exactly identical in structure and function to that just described and, hence, will not be repeated, for the sake of brevity, it being sufficient to note that like parts have been identified with like primed numerals.

As best shown in FIG. 2, prior to mounting the end caps 74, 74' in place at and about the housing end regions 16,18, the shortcircuit chambers 30, 32 are filled with fillers 80, 82 of particulate material, for example, sand.

In further accordance with this invention, a pair of plate-shaped heat sinks 84, 86, preferably made of copper, are located within the overload chamber 34. Upper heat sink 84 has a lower generally planar contact surface 88 which faces an upper abutment surface 90 of the second end region 58 of the link 50, as well as an upper abutment surface 92 of the second end region 60 of link 52. Lower heat sink 86 has an upper generally planar contact surface 94 which faces a lower abutment surface 96 of the second end region 58 of link 50, as well as a lower abutment surface 98 of the second end region 60 of link 52. The abutment surfaces 90, 96 are located on opposite lateral sides of the link end region 58, and the abutment surfaces 92, 98 are located at opposite lateral sides of the link end region 60. The contact surfaces 88, 94 generally are planar, are juxtaposed on opposite sides of the link end regions 58, 60, and face each other in a mutual parallelism.

As best shown in FIG. 2, the contact surface 88 normally is interconnected by a eutectically soldered bond 100 to both upper abutment surfaces 90, 92, and the contact surface 94 similarly normally is interconnected by the same eutectically soldered bond 100 to both lower abutment surfaces 96, 98, and the contact surfaces 88, 94 normally are interconnected to each other by the same eutectically soldered bond 100. The eutectically soldered bond is a solder preferably composed of an alloy of lead and tin in a ratio of about 37% to 63%, respectively, by weight, and having a relatively sharply defined melting point of about 360° F.

As also shown in FIG. 2, each heat sink 84, 86 extends longitudinally between and bridges the abutment surfaces 90, 92 and 96, 98, respectively. Thus, an electrically-conductive path is formed and constitutes a normal operating condition of the fuse, wherein the heat sinks are in mutual contact with each other, and wherein the conductive path extends between the terminals 36 and 38, and through the links 50, 52 and through the heat sinks 84, 86. An electrical current conducted between the terminals 36, 38 flows along this conductive path and along the links and heat sinks in the aforementioned normal operating condition. At the same time, the electrical resistance offered by the links, and particularly by the apertured bent body portions 62, 64, generates heat, which heat normally is absorbed and dissipated by the heat sinks when the electrical current is at or below a predetermined safety limit which, typically, is not more than 110% over the rated current which the fuse is designed safely to handle in its normal working condition.

In a first overload condition, which is conveniently defined as when the current is about 135% over the rated current, the bent body portions 62, 64 generate more heat than in the previous normal condition, and this excess heat is conducted to the heat sinks in the region of the eutectically soldered bond therebetween. The heat sinks, at least partially but not completely, absorb this excess heat and dissipate it. However, the heat sinks are so designed that, after about two hours maximum, the heat generated at the second end regions 58, 60 is sufficient to melt the eutectic bond 100.

In a second overload condition, which is conveniently defined as when the current is about 200% above the rated current, the bent body portions 62, 64 generate still more heat than in the previous first overload condition, and this excess heat is, again, at least partially but not completely, absorbed and dissipated by the heat sinks. The heat sinks are so designed that, after about twelve minutes maximum, the heat at the second end regions 58, 60 is sufficient to melt the eutectic bond.

In a third overload condition, which conveniently is defined as when the current is about 500% above the rated current, the bent body portions 62, 64 generate still more heat than in the previous second overload condition, and this excess heat is, again, at least partially but not completely, absorbed and dissipated by the heat sinks. The second end regions 58, 60 generate so much heat that, after about ten seconds minimum, the heat is sufficient to melt the eutectic bond.

In all of the aforementioned representative overload conditions, once the eutectic bond melts, which, as described above, occurs rather sharply at about 360° F., the contact surfaces 88, 94 are freed from soldered engagement from the opposite sides of the second end regions 58, 60 of the links.

In further accordance with this invention, the heat sinks 84, 86 are formed with centrally located bores 102, 104 extending from the contact surfaces 88, 94 in a radial direction generally perpendicular to the planes in which the contact surfaces lie, and terminating in interior annular shoulders 106, 108. In addition, heat sinks 84, 86 also are formed with through-holes 110, 112 extending from the shoulders 106, 108 all the way through the heat sinks 84, 86. The through-holes are surrounded by upright, tubular, annular neck portions 114, 116.

An elongated compressible coil spring 118 is located between the heat sinks. One coiled end section 120 of the spring is seated in bore 102 and engages the shoulder 106. The opposite coiled end section 122 of the spring is seated in bore 104 and engages the shoulder 108. In the normal condition of the heat sinks, i.e. when they are soldered to each other and to the link end regions 58, 60, the spring 118 is compressed and energy is stored therein. The spring constantly exerts a force in the radial direction generally perpendicular to the planes in which the contact surfaces 88, 94 lie. However, in the normal condition, the radially directed force exerted by the spring 118 is insufficient to overcome the eutectically soldered bond.

In the event of an overload condition, wherein the eutectically soldered bond 100 melts, the radially directed force exerted by the spring 118 is sufficient to urge the contact surfaces 88, 94 apart from each other lengthwise of the spring in the radial direction. At least some of the stored energy of the spring 118 thus is released, and the spring extends toward its original uncompressed length. Once the contact surfaces 88, 94 are apart from each other, the fuse is "blown", and the aforementioned electrically-conductive path through the fuse is interrupted.

The radially outward movement of the heat sinks 84, 86 is stopped when the neck portions 114, 116 abut against respective stop surfaces 124, 126 provided on spacer elements 128, 130. The spacer elements 128, 130 are mounted within the overload chamber, and have central guide projections 132, 134 which are received within the through-holes 110, 112 and, at least in part, through the open axial ends of the spring and into the open interior thereof after the heat sinks 84, 86 have been moved apart. The guide projections and the spring tend to maintain the heat sinks away from each other and away from the link end regions 58, 60 in order to prevent re-striking.

The upper spacer element 128 has end supports 136, 138 which are fitted tightly into notches formed in the upper parts of the barrier partitions 26, 28. The lower spacer element 130 has end supports 140, 142 which analogously are fitted tightly into notches formed in the lower parts of the barrier partitions 26, 28. The spacer elements generally are planar and, preferably, are constituted of an electrically-insulating fiber.

As noted previously, once an overload current is caused to flow through the fuse, the amount of heat generated is directly proportional to the amount by which the overload current exceeds the current specifically rated for normal operation. The heat generated in an overload condition does not instantaneously melt the eutectically soldered bond 100 because of a time delay introduced by the heat sinks 84, 86 which act to absorb and dissipate at least some of the heat. This time delay is determined, at least in part, by the mass, size and material of the heat sinks, as well as the heat dissipation, conduction, convection and radiation characteristics of the heat sinks. For example, in a preferred embodiment of a fuse capable of normally handling currents in the 101 to 200 ampere range, each heat sink, which preferably is made of copper, has the following dimensions: 1.125" in length, 0.650" in width, and 0.187" in thickness.

The present invention particularly is suitable for 100 ampere fuses which are rated safely to handle currents in the range of 61 to 100 amperes, 200 ampere fuses which safely are rated to handle currents in the range of 101 to 200 amperes, 400 ampere fuses which safely are rated to handle currents in the range of 201 to 400 amperes, and 600 ampere fuses which safely are rated to handle currents in the range of 401 to 600 amperes. The above-described 100, 200, 400 and 600 ampere fuses merely are exemplificative, and it will be understood that higher and lower ampere fuses likewise are in the spirit of this invention.

The above-described time delays of about two hours maximum for a 135% overload current and about ten seconds minimum for a 500% overload current preferably are valid for each of the 100, 200, 400 and 600 ampere fuses. For the above-described time delay of about twelve minutes maximum for a 200% overload current, this time delay preferably is valid only for the 600 ampere fuse. For the 400, 200 and 100 ampere fuses for a 200% overload, the time delays preferably are about ten minutes maximum, eight minutes maximum and six minutes maximum, respectively.

The overall assembly of the fuse is particularly simple. First, the spring 118 is located between the heat sinks 84, 86, and then the contact surfaces of the latter are soldered to the second end regions 58, 60 of the links. Thereupon, the barrier partitions 26, 28 and the spacer elements 128, 130 are mounted about the joined heat sinks to complete the assembly of the overload chamber 34. Then, the first end regions 54, 56 of the links 50, 52 are soldered to the terminal end regions 40, 42. The resulting assembly thereupon is inserted into the housing 12 through either end region thereof. The fillers 80, 82 then are introduced into each shortcircuit chamber 30, 32. The end barriers 22, 24 then respectively are overlaid with the open ends of the housing. Next, the end caps 74, 74' are fitted tightly over the housing end regions 16, 18, whereupon the hollow pins 66, 66' are inserted through the aforementioned juxtaposed holes. The assembly is completed by driving the pins 76, 78 into opposite ends of the tubular pin 66 and, similarly, by driving the pins 76' and 78' into the open ends of the tubular pin 66'. This overall assembly is a particularly durable and rugged construction.

Figure 4:
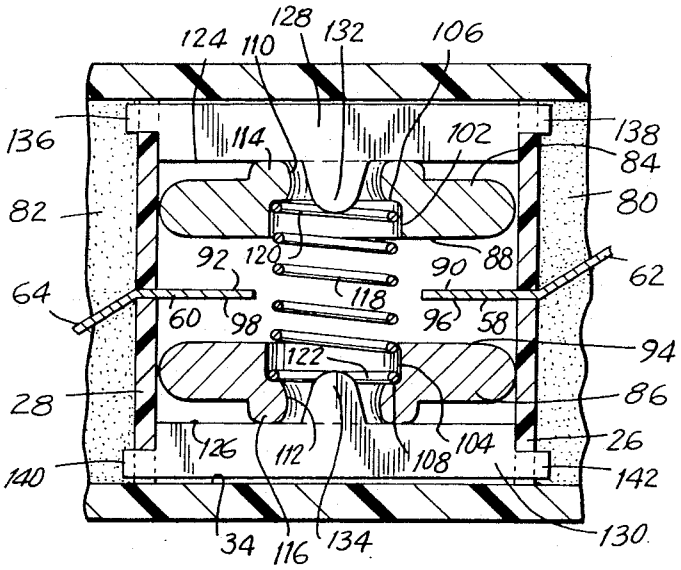
FIG. 4 is an enlarged sectional view of the overload chamber of FIG. 1 and its components in an overload condition.
Figure 3:
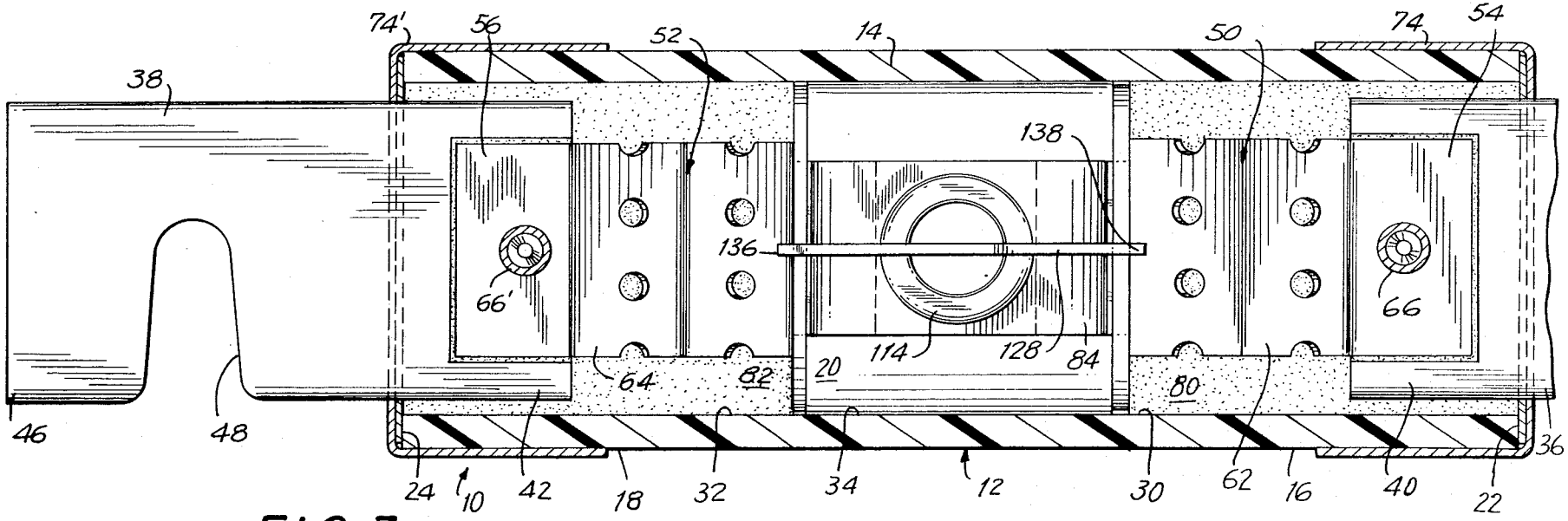
FIG. 3 is a sectional view taken along line 3—3 of FIG. 2.
Figure 5:
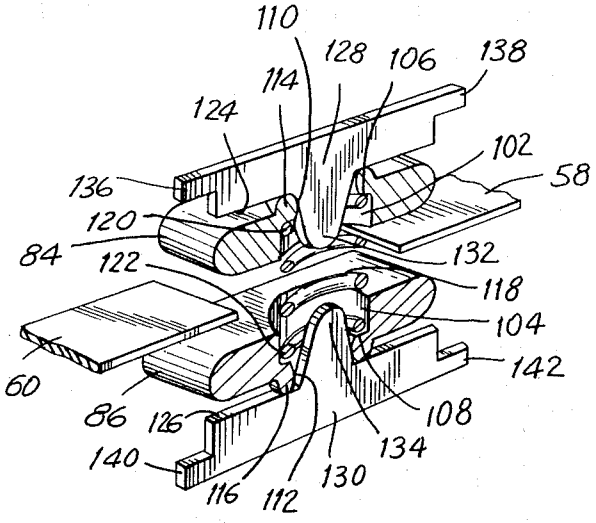
FIG. 5 is a perspective view of the components of FIG. 4.

As shown in FIG. 4, the distance X, which represents the maximum separation between the contact surfaces 88, 94 in the overload or blown condition of the fuse, is relatively great to prevent arcing. In preferred embodiments of a 200, 400 and 600 ampere fuse, the distance X is 0.353", 0.427" and 0.507", respectively.

If it is desired to change the melting point of the eutectically soldered bond 100, then the addition of cadmium in appropriate quantities may be employed for reducing the melting point to about 300° F., and the addition of bismuth may be employed for still further lowering the melting point to about 200° F.

As described herein, the fuse blows, not only in the aforementioned representative first, second and third overload conditions, but at any overload condition in excess of about 110% of the rated current. At a 110% overload current or below, the mass and heat dissipation characteristics of the heat sinks 84, 86 are sufficient to prevent the fuse ever from blowing.

In a shortcircuit condition, i.e. when the overload current is on the order of 1000% over the rated current and above, the fusible links 50, 52 in the shortcircuit chambers 30, 32 almost instantaneously fuse in their bent body regions, and thereby protect the electrical circuit by interrupting the conductive path through the fuse.

It will be understood that each of the elements described above, or two or more together, may also find a useful application in other types of constructions differing from the types described above.

While the invention has been illustrated and described as embodied in a heavy-duty, time-delay fuse, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A heavy-duty, time-delay fuse, comprising:

(A) an elongated, hollow, tubular housing having opposite end regions and bounding an interior space;

(B) a pair of electrically-conducting terminals, each being located at, and extending outwardly past, a respective end region of the housing;

(C) a pair of elongated, fusible links, each being located within the interior space and extending between a first end region which is electrically connected to a respective terminal, and a second end region which has opposite abutment surfaces, the second end regions being longitudinally spaced apart from each other, (i) each link being constituted of an electrically-conducting material for enabling an electrical current conducted between the terminals to flow along the links, and each link at least partially resisting the electrical current flow for generating heat in an amount proportional to the magnitude of the electrical current flow;

(D) a pair of heat sinks located within the interior space and having generally planar, juxtaposed, contact surfaces facing each other in a mutual parallelism, each contact surface being located at, and normally interconnected by a eutectically soldered bond to, respective abutment surfaces of both links, (i) each heat sink extending longitudinally between the spaced-apart second end regions and being constituted of an electrically-conducting material for enabling the electrical current to flow along the heat sinks, and for at least partially absorbing and dissipating the heat amounts generated by the links, each eutectically soldered bond being meltable at a predetermined melting point; and (E) biasing means located within the interior space, and operative for urging the contact surfaces apart from each other in a direction generally perpendicular to the planes in which the contact surfaces lie, and for maintaining the contact surfaces apart and in said mutual parallelism, in the event of an overload condition in which an overload electrical current having a magnitude above that of a rated electrical current is conducted between the terminals and causes the links to generate heat in an overload amount exceeding said predetermined melting point and sufficient to melt the eutectically soldered bonds between the contact surfaces and the respective abutment surfaces after a predetermined time delay proportional to the amount of heat absorbed and dissipated by the heat sinks.

2. The fuse as recited in claim 1, wherein said housing is elongated along a longitudinal axis, and wherein said biasing means is operative for urging the contact surfaces apart from each other in a radial direction.

3. The fuse as recited in claim 1, wherein said housing includes partition walls for subdividing the interior space into a shortcircuit chamber within each end region of the housing, and an overload chamber located between the end regions of the housing; and wherein said heat sinks, said biasing means and each second end region of said links are located in the overload chamber.

4. The fuse as recited in claim 3, wherein said housing includes a filler of a particulate material within each shortcircuit chamber.

5. The fuse as recited in claim 1, wherein each link has a bent body portion between said first and second end regions of the respective link, said bent body portion having a plurality of holes formed therethrough to reduce the effective cross-section and increase the resistance to the electrical current flow through the respective link.

6. The fuse as recited in claim 1, wherein said first end region of each link is connected by a high-temperature-melting solder to the respective terminal, said high-temperature-melting solder having a melting point above said predetermined melting point.

7. The fuse as recited in claim 6; and further comprising means for anchoring the interconnected first end region of each link and the respective terminal to the respective end region of the housing.

8. The fuse as recited in claim 1, wherein each heat sink is a generally plate-shaped member and has a centrally located bore formed with an interior annular shoulder; and wherein the biasing means constitutes an elongated coil spring having opposite end regions seated in a respective bore and engaging a respective shoulder.

9. The fuse as recited in claim 1, wherein the eutectically soldered bond consists of tin and lead in a ratio of about 63 to 37 by weight, and wherein said predetermined melting point is about 360° F.

10. The fuse as recited in claim 1, wherein each heat sink is constituted of copper and has a mass sufficient to absorb and dissipate heat in amounts sufficient to melt the eutectically soldered bonds after a time delay of about ten seconds minimum in the event of an overload current having a magnitude which is 500% above the rated current, about twelve minutes maximum in the event of an overload current having a magnitude which is 200% above the rated current, and about two hours maximum in the event of an overload current having a magnitude which is 135% above the rated current; and wherein said mass is sufficient to absorb and dissipate heat in amounts sufficient never to melt the eutectically soldered bonds in the event of an overload current having a magnitude which is 110% above the rated current.

11. A heavy-duty, time-delay fuse, comprising:

(A) a hollow, tubular housing elongated along a longitudinal axis and having opposite end regions, said housing having a side wall bounding an interior space;

(B) a plurality of partitions mounted within, and subdividing, the interior space of the housing into a first shortcircuit chamber at one end region of the housing, a second shortcircuit chamber at the other end region of the housing, and an overload chamber intermediate the first and second shortcircuit chambers;

(C) a pair of electrically-conducting, plate-shaped terminals, each having an interior end region located within a respective shortcircuit chamber, and extending outwardly past a respective end region of the housing and terminating in an exterior free end region;

(D) a pair of elongated, generally planar fusible links, each having a generally planar first end region soldered to a respective interior end region of a terminal within the respective shortcircuit chamber, a generally planar second end region located within the overload chamber, and a generally planar bent body portion intermediate the first and second end regions, the second end regions being longitudinally spaced apart from each other and having opposite abutment surfaces, (i) each link being constituted of an electrically-conducting material for enabling an electrical current conducted between the terminals to flow along the links, and each bent body portion being apertured to decrease the effective cross-section thereof and at least partially increase the resistance to the flow of the electrical current therethrough and thereby to generate heat in an amount proportional to the magnitude of the electrical current flow;

(E) means for anchoring each soldered first end region to the side wall of the housing;

(F) a filler of particulate material filling each shortcircuit chamber;

(G) a pair of plate-shaped heat sinks located within the overload chamber and having generally planar, juxtaposed contact surfaces facing each other in a mutual parallelism, each contact surface being located at, and normally interconnected by a eutectically soldered bond to, respective abutment surfaces of both links, (i) each heat sink extending longitudinally between and bridging the spaced-apart second end regions and being constituted of an electrically-conducting material for enabling the electrical current to flow along the heat sinks, and for at least partially absorbing and dissipating the heat amounts generated by the links, each eutectically soldered bond being meltable at a predetermined melting point, (ii) each heat sink having a centrally located bore having an interior annular shoulder, and a through-hole aligned with the bore;

(H) an elongated compressible coil spring located between the heat sinks and having opposite end sections, each seated in a respective bore and engaging the respective shoulder, said spring being normally compressed in a working condition in which a rated electrical current is conducted between the terminals, (i) said spring being extendable for urging the contact surfaces apart from each other in a radial direction generally perpendicular to the planes in which the contact surfaces lie, in the event of an overload condition in which an overload electrical current having a magnitude above that of the rated electrical current is conducted between the terminals and causes the links to generate heat in the vicinity of their second end regions in an overload amount exceeding said predetermined melting point and sufficient to melt the eutectically soldered bonds between the contact surfaces and the respective abutment surfaces after a predetermined time delay proportional to the amount of heat absorbed and dissipated by the heat sinks; and (I) a pair of spacer elements within the overload chamber, each element having a guide projection extending in the radial direction and being received at least partially within a respective through-hole of the heat sinks after the contact surfaces have been moved apart from each other.

12. A heavy-duty, time-delay fuse, comprising:

(A) an elongated, hollow, tubular housing having opposite end regions and bounding an interior space;

(B) a pair of electrically-conducting terminals, each being located at, and extending outwardly past, a respective end region of the housing;

(C) a pair of elongated, fusible links, each being located within the interior space and extending between a first end region which is electrically connected to a respective terminal, and a second end region which has opposite abutment surfaces, the second end regions being longitudinally spaced apart from each other, (i) each link being constituted of an electrically-conducting material for enabling an electrical current conducted between the terminals to flow along the links, and each link at least partially resisting the electrical current flow for generating heat in an amount proportional to the magnitude of the electrical current flow;

(D) a pair of heat sinks located within the interior space and having generally planar, juxtaposed, contact surfaces facing each other in a mutual parallelism, each contact surface being located at, and normally interconnected by a eutectically soldered bond to, respective abutment surfaces of both links, (i) each heat sink extending longitudinally between the spaced-apart second end regions and being constituted of an electrically-conducting material for enabling the electrical current to flow along the heat sinks, and for at least partially absorbing and dissipating the heat amounts generated by the links, each eutectically soldered bond being meltable at a predetermined melting point, (ii) each heat sink being a generally plate-shaped member and having a centrally located bore formed with an interior annular shoulder; and (E) biasing means located within the interior space, and operative for urging the contact surfaces apart from each other in a direction generally perpendicular to the planes in which the contact surfaces lie, in the event of an overload condition in which an overload electrical current having a magnitude above that of a rated electrical current is conducted between the terminals and causes the links to generate heat in an overload amount exceeding said predetermined melting point and sufficient to melt the eutectically soldered bonds between to contact surfaces and the respective abutment surfaces after a predetermined time delay proportional to the amount of heat absorbed and dissipated by the heat sinks, (i) said biasing means constituting an elongated coil spring having opposite end regions seated in a respective bore and engaging a respective shoulder.

13. The fuse as recited in claim 12, wherein the spring is compressible and is compressed between the heat sinks when the contact surfaces are interconnected to the respective abutment surfaces of both links.

14. The fuse as recited in claim 13, wherein the spring has open end regions, and wherein each heat sink has a through-hole in alignment with a respective open end region of the spring; and further comprising a pair of spacer elements located within the interior space, each spacer element having a guide projection extending in the direction generally perpendicular to the planes in which the contact surfaces lie, each guide projection being received within a respective through-hole and the associated aligned open end region of the spring in the overload condition after the contact surfaces have been moved apart from each other.

* * * * *